US005543809A

United States Patent [19]

Profera, Jr.

[11] Patent Number: 5,543,809

[45] Date of Patent: Aug. 6, 1996

[54] REFLECTARRAY ANTENNA FOR COMMUNICATION SATELLITE FREQUENCY RE-USE APPLICATIONS

[75] Inventor: Charles E. Profera, Jr., Cherry Hill, N.J.

[73] Assignee: Martin Marietta Corp., East Windsor, N.J.

[21] Appl. No.: 848,055

[22] Filed: Mar. 9, 1992

[51] Int. Cl.[6] ..... H01Q 1/28; H01Q 3/46; H01Q 19/17; H01Q 21/24

[52] U.S. Cl. ..... 343/753; 343/755; 343/756; 343/779; 343/909; 343/913

[58] Field of Search ..... 343/700 MS, 705, 343/756, 794, 797, 810, 815, 816–818, 909, 910, 912, 912, DIG. 2, 701, 753, 754, 755, 779; H01Q 1/28, 3/46, 9/16, 9/20, 9/22, 15/02, 19/13, 15/10, 19/17, 15/14, 15/24

[56] References Cited

U.S. PATENT DOCUMENTS

| | | | |
|---|---|---|---|
| 4,590,480 | 5/1986 | Nikolayuk et al. | 343/771 |
| 4,684,952 | 8/1987 | Munson et al. | 343/700 MS |
| 4,733,244 | 3/1988 | Edenhofer et al. | 343/909 |
| 4,905,014 | 2/1990 | Gonzalez et al. | 343/909 |
| 5,014,070 | 5/1991 | Stock et al. | 343/700 MS |

FOREIGN PATENT DOCUMENTS

| | | | |
|---|---|---|---|
| 2237936 | 5/1991 | United Kingdom | H01Q 3/46 |

*Primary Examiner*—Peter T. Brown
*Attorney, Agent, or Firm*—W. H. Meise; C. A. Berard; S. A. Young

[57] ABSTRACT

A dual-polarized antenna includes a planar line or surface array of reradiating elements of two different polarizations. Each reradiating element in one embodiment is a short-circuited vertical or horizontal dipole. The vertical and horizontal dipoles may be collocated on the array to form crossed short-circuited dipoles. The elements of each polarization form an array separate from the elements of the other polarization. Within each of the two separate arrays, the 1/λ of each reradiator is adjusted to provide a phase shift which causes a collimated beam incident on the array to result in reradiation or "reflection" of energy in the form of a beam converging at a focal point. Therefore, each planar reradiator array acts as a parabolic reflector with a particular focal point. The focal points for the vertical and horizontal arrays are different, and a feed of the appropriate polarization is located at each of the two focal points. A satellite includes a communication system operating in a "frequency re-use" mode, with mutually alternate, overlapping-frequency channels transmitted (and received) on mutually orthogonal polarizations.

20 Claims, 3 Drawing Sheets

REFLECTARRAY ANTENNA FOR COMMUNICATION SATELLITE FREQUENCY RE-USE APPLICATIONS

BACKGROUND OF THE INVENTION

This invention relates to antennas, and more particularly to satellites with dual-polarization antennas including a separate feed for each polarization.

Communication satellites are in widespread use for communicating data, video and other forms of information between widely spaced locations on the earth's surface. It is well known that communication satellites are expensive, and that they have a lifetime which is limited by consumption of expendables, notably consumption of propellant which is used for attitude control and for North-South stationkeeping. In order to provide as much propellant as possible at the beginning of a spacecraft's life, the weight of every portion of the spacecraft is scrutinized, and costly tradeoffs are made to save weight to allow on-loading of additional propellant to extend the life of the satellite. The value of a single month of additional operation of a satellite can be millions of dollars, so a weight saving of even a few pounds, for which propellant can be substituted, may result in tens of millions of dollars of savings.

Among the larger structures on the spacecraft are the solar panels, which require a relatively large surface facing the sun in order to intercept sufficient energy to generate electricity for the spacecraft's operation, and the transmitting and receiving antennas.

The antennas are transducers between transmission lines and free space. A general rule in antenna design is that, in order to "focus" the available energy to be transmitted into a narrow beam, a relatively large "aperture" is necessary. The aperture may be provided by a broadside array, a longitudinal array, an actual radiating aperture such as a horn, or by a reflector antenna which, in a receive mode, receives a collimated beam of energy and focuses the energy into a converging beam directed toward a feed antenna, or which, in a transmit mode, focuses the diverging energy from a feed antenna into a collimated beam.

Those skilled in the art know that antennas are reciprocal devices, in which the transmitting and receiving characteristics are equivalent. Generally, antenna operation is referred to in terms of either transmission or reception, with the other mode being understood therefrom.

For various reasons relating to reliability, light weight and cost, many current communication satellites employ "frequency re-use" communications systems. Such a system is described, for example, in U.S. Pat. No. 5,287,543, issued Feb. 15, 1994 in the name of Wolkstein. In a frequency re-use system, independent signals are transmitted from a earth station over a plurality of band limited "channels" which partially overlap in frequency. At the transmitting earth station, mutually adjacent channels are cross-polarized. In this context, cross-polarization means that the signals of a particular channel are transmitted with a particular first polarization, while the signals of the two adjacent channels are transmitted at a second polarization orthogonal to the first. Ordinarily, each of the two orthogonal polarizations are two linear polarizations, which may be referred to as "vertical" and "horizontal", although, as known, precipitation causes rotation of the polarization. In principle, the two orthogonal channels could be right and left circular polarizations, but linear vertical and horizontal are more easily controlled. At the satellite, the vertically and horizontally polarized signals are separated by polarization-sensitive antennas and applied to separate transmission lines. This has the result which, in each channel, tends to suppress the signals relating to the two adjacent channels. Thus, even though the frequencies of the signals in each channel partially overlap, the overlapping frequency adjacent-channel signals are suppressed, which tends to reduce interchannel interference.

In the satellite, the received signals from the vertically and horizontally polarized antennas are converted to a different frequency range, filtered, and amplified as required, to produce independent signals in adjacent channels with partially overlapping frequencies within the converted frequency range, which independent signals are then combined or de-multiplexed, and every other (or alternate) channels are applied to one polarization of a dual polarization antenna for retransmission back to the earth. As in the case of the receving or uplink antenna, the transmitting or downlink antenna tends to maintain a degree of isolation between each channel and its immediate neighbors.

A prior art antenna which has been used for communication satellites includes a first reflector made up of mutually parallel, "vertically" polarized conductors lying along a surface having the shape of a parabola of revolution, and having a focus at which a vertically polarized feed antenna structure is located. Vertically polarized signals are reflected by the first reflector acting as a parabolic reflector, to collimate diverging signals radiated by the feed antenna to form a collimated beam which is directed toward the ground station, and for receiving collimated signals from the ground station and focusing the collimated signals onto the feed antenna. Horizontally-polarized signals, however, pass unimpeded through the vertically polarized conductive elements of the first reflector. A second reflector, located immediately before or immediately after the first reflector, consists of a plurality of mutually parallel, "horizontally" polarized conductive elements, forming a second parabolic reflector having a focal point at a second location different from that of the first focal point. A horizontally polarized feed antenna structure is located at the second focal point.

The above described prior art antenna requires two separate parabolic reflectors, each formed from a elongated conductive grid, and each with a different focal point. The fabrication of the supports which lie between the two reflectors is difficult, and its presence tends to distort the radiation pattern of the rearmost reflector.

SUMMARY OF THE INVENTION

A satellite includes a frequency reuse communications system with an antenna. The antenna includes arrays of first and second reradiators of electromagnetic energy. Each reradiator responds to one of two orthogonal polarizations by reradiating signals of that same polarization. The first reradiators respond to the first polarization, and the second reradiators respond to the orthogonal polarization. The first and second reradiators are arrayed in a line or surface array. Within each array, the dimensions of the radiators of the array are selected, depending upon the location of the reradiator within the array, in order to create phase shifts which essentially cause the first array and the second array to each act as a parabolic reflector, for focusing collimated beams entering the aperture into converging beams directed towards separately located focal points, one for the first polarization and the other for the orthogonal polarization. At the focal points, feed antennas transduce energy between transmission lines and the arrays.

DESCRIPTION OF THE INVENTION

Figure 1:
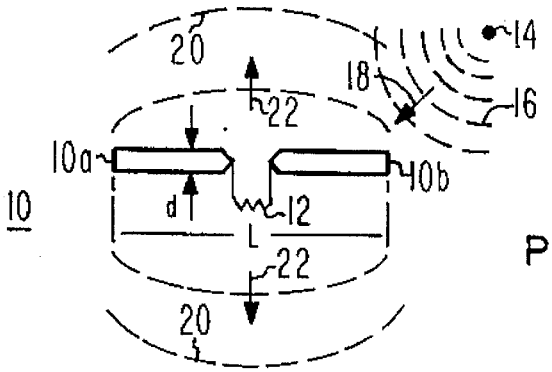
Fig. 1 PRIOR ART
FIG. 1 illustrates a dipole antenna reradiating signals received from a point source.

FIG. 1 illustrates a conductive dipole antenna 10 including two sections 10*a*, 10*b* defining an overall length (L) and a diameter (d). The mutually adjacent ends of dipole elements 10*a*, 10*b* are connected together through a resistance element illustrated as 12. In the absence of energization, dipole antenna 10 does not radiate. A point source illustrated as 14 generates electromagnetic energy, represented by dotted lines 16, which radiate outward from point source 14, and in particular radiate in the direction of arrow 18 toward dipole 10. When electromagnetic energy 16 impinges upon dipole 10, currents are induced in the dipole, which cause it to reradiate electromagnetic energy in accordance with a standard dipole radiating pattern (not illustrated). The radiated energy is represented by dash lines 20, which propagate away from dipole 10, and in the direction of arrow 22 in normal dipole manner.

As so far described, dipole element 10 is simply a reradiator. The energy transmitted thereto is reradiated in directions which are not dependent upon the location of source 14, but instead are dependent upon the radiation pattern of the dipole. The amount of reradiation depends in part upon the value of a center resistance 12 connected between dipole elements 10*a* and 10*b*. The reradiation is minimized when resistor 12 has a value which matches the radiation resistance of the dipole, and is maximized when resistor 12 is a short-circuit.

Figure 2:
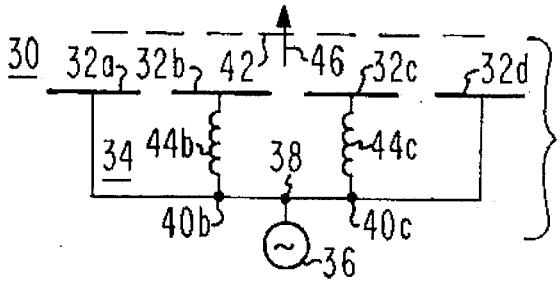
Fig. 2 PRIOR ART
FIG. 2 illustrates a line array fed from a beamformer including a delay line.

FIG. 2 illustrates an array designated generally as 30 of dipole antennas elements 32*a*, 32*b*, 32*c* and 32*d*, driven by a beamforming network designated generally as 34 from a source 36. Beamforming network 34 includes transmission paths extending from a central feed location 38, past the feed points 40*b*, 40*c* for antenna elements 32*b* and 32*c*, to outermost antenna elements 32*a*and 32*d*. That portion of beamforming network 34 lying between feed point 40*b* and antenna 32*a*, and that portion lying between feed point 40*c* and antenna element 32*d*, introduce delays in the signal coupled to outermost elements 32*a* and 32*d* relative to the signal arriving at feed points 40*b* and 40*c*. In order to achieve a narrow directional beam, a flat or uniform phase front is desired, illustrated by dash line 42 in FIG. 2. A uniform phase front is achieved by delay elements illustrated as 44*b* and 44*c*, which are coupled between feed points 40*b* and antenna 32*b*, and feed point 40*c* and antenna 32*c*, respectively. The delays introduced by elements 44*b* and 44*c* are equal to the excess delays in the feed signals to antenna elements 32*a* and 32*d* occasioned by extra lengths in beamforming network 34. Such an arrangement results in a flat phase front of energy which propagates in a broadside direction, illustrated as arrow 46, relative to array 30, thereby forming a directional beam. In the absence of delay elements 44*b*, 44*c*, radiation would tend to be distributed across wide angles without forming a narrow beam.

Figure 3:
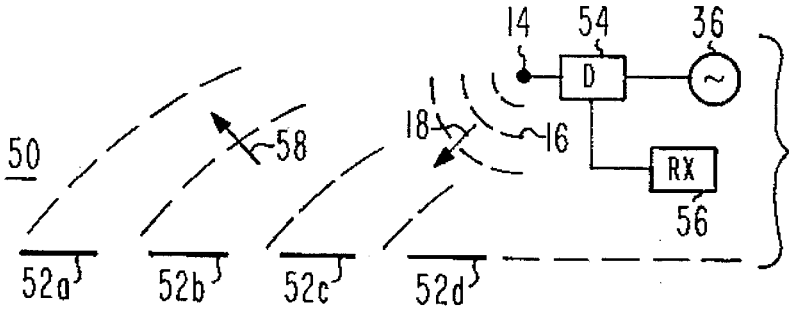
Fig. 3 PRIOR ART
FIG. 3 illustrates a line array of reradiators fed from a point source, together with a representation of the resulting radiation direction.

FIG. 3 illustrates an array, designated generally as 50, of short-circuited dipole elements 52*a*, 52*b*, 52*c* and 52*d*. In FIG. 3, a source 36 is coupled by way of a diplexer (D) 54 to a radiating feed point 14. A receiver (RX) 56 is coupled by way of diplexer 54 to feed point 14. Signals coupled to feed point 14 generate a diverging pattern of energy illustrated by dotted line 16, which propagates outward from point 14, and particularly in the direction of arrow 18. While the carriers which are contemplated are generally continuous or possibly pulse-amplitude modulated, explanation of the phase characteristics is more readily explained by assuming a wave "front", as though radiation from source 14 were just beginning. With this assumption, it is readily understandable from FIG. 3 that the wave front originating from point source 14 arrives "first" at reradiating element 52*d*. At that time, element 52*d* begins to respond by generating a reradiation pattern which depends upon its own radiation characteristics. For the illustrative case of a dipole antenna, the conventional "toroidal" pattern is reradiated. After the phase front originating from point 14 passes element 52*d*, it arrives in succession at reradiating elements 52*c*, 52*b* and 52*a*, each of which responds in succession by reradiating its own particular pattern. When all of the reradiating elements 52*a*, 52*b*, 52*c* and 52*d* are radiating in response to a continuous carrier, an array is formed in which the right-most radiators 52*c* and 52*d* are phase advanced relative to left-most elements 52*a* and 52*b*, which relationships are such as to generate propagation in the direction of arrow 58. If reradiation elements 52*a*, 52*b*, 52*c* . . . of array 50 were very closely spaced and very small, the "apertures" of each of the small elements would be essentially unidirectional, and the array as a whole would act much like a mirror, reflecting energy arriving from the direction of arrow 18 by reflecting it in direction 58, with the incident and reflected paths making equal angles with a normal to the array. To the extent that the reradiation elements 52 have relatively broad radiation patterns, their array approximates the effect of a reflector. As illustrated in FIG. 3, the reradiated radiation pattern is not collimated, and produces diverging energy rather than a collimated beam.

Figure 4:
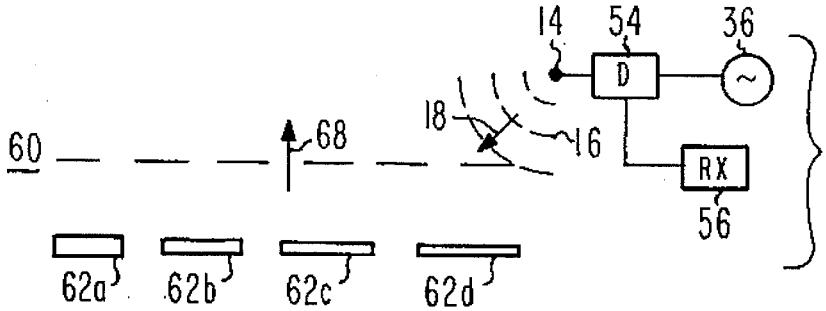
FIG. 4 illustrates an arrangement similar to that of FIG. 3, but in which the dimensions of the reradiators are selected to produce a collimated beam.

In FIG. 4, an array 60 of reflector elements 62*a*, 62*b*, and 62*c* and 62*d* are energized by radiation, illustrated as 16, propagating in the direction of arrow 18 from point source 14. Array 60 differs from array 50 in that the lengths and diameters of the reradiating elements 62 are different from one to the other, whereas reradiating elements 52 of array 50 are identical. In general, an elongated conductive element such as dipole 10, or a reradiating element 32, 52 or 62, acts as a damped resonator, in which the quality factor (Q), (the ratio of stored energy to energy dissipated per unit time), depends upon the dimensions of the element, as well as upon other factors such as the loss of the conductor. A major source of energy loss from the reradiator is the "radiation resistance" of the equivalent antenna, which represents the transfer of energy away from the reradiator element by radiation mechanisms. The radiation resistance depends upon the length (L) of the radiator in terms of the wavelength ($\lambda$) of the signal being reradiated ($L/\lambda$). In general, a reradiator element which is longer than $\lambda$ will tend to be inductive, which will tend to delay the reradiation signal relative to the incident signal, and an element shorter than $\lambda$ will tend to be capacitive and will tend to delay the signal reradiation less than a longer reradiator element. Thus, the length, and to a lesser extent the diameter, of the reradiator element allow phase adjustment of the reradiated signal. In FIG. 4, antenna elements such as antenna elements 62*d*, which are closest to source 14, are both longer and smaller in diameter than those elements, such as elements 62*a*, which are farthest from source 14. This has the result of tending to delay reradiation from reradiating elements 62*d* more than the delay imparted by elements such as 62*a*. This in turn tends to produce a collimated beam which is directed in the direction of arrow 68, more broadside to the antenna array than arrow 58 of FIG. 3.

Figure 5:
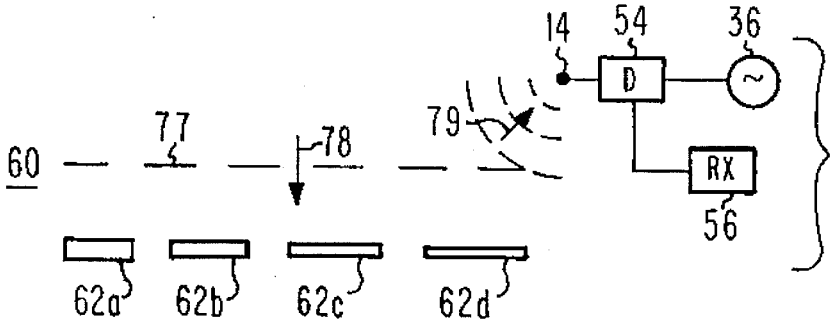
FIG. 5 is similar to FIG. 4, with the direction of energy flow reversed.

FIG. 5 is similar to FIG. 4, and illustrates a collimated uniform phase front 77 moving in the direction of arrow 78 toward array 60, arranged with varying-length reradiating elements 62 as in FIG. 4. Wavefront 77 arrives at all reradiating elements simultaneously, and is reradiated by element 62*a* with less delay than that of the other reradiators, and is reradiated by element 62*d* with a maximum delay. This relative delay results in a converging beam of energy moving in the direction of arrow 79 toward point source 14. The converging energy is received at feed point 14, and is coupled by diplexer 54 to receiver 56.

Figure 6A:
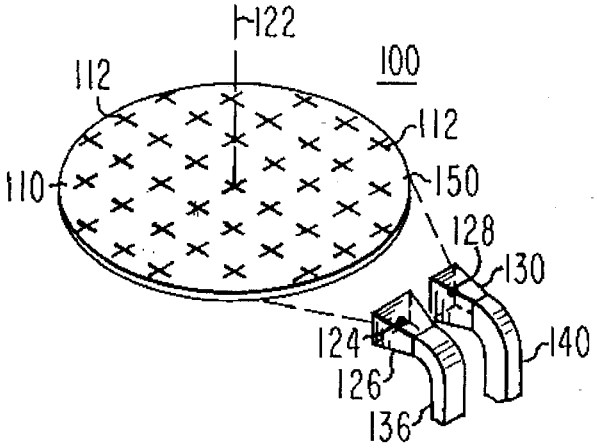
FIG. 6*a* is a simplified representation of a reflectarray antenna in accordance with the invention.

FIG. 6*a* is a simplified perspective or isometric view of a reflectarray antenna in accordance with the invention. In FIG. 6*a*, antenna 100 includes a circular two-dimensional array illustrated as 110, of individual cross-polarized reradiators, some of which are designated 112, supported on a dielectric substrate 150. FIG. 6*c* is a plan view of representative dual-polarized reradiator 112. In FIG. 6*c*, reflector 112 includes a first elongated reradiator including portions 114*a*, 114*b* which together define a first element elongated in the direction of an axis 118, and a second element including portions 116*a*, 116*b* which together constitute a second elongated conductive element elongated in the direction of an axis 120 which is orthogonal to axis 118. The length and width dimensions of reradiating element 112 can be selected independently for each of the two portions 114, 116 in order to provide different delays or phase shifts for signals of the two different polarizations impinging thereupon. Thus, no matter where in the array a particular reradiator 112 may be located, its vertical and horizontal portions may be independently dimensioned to focus a collimated beam at a desired point, which may be different for each polarization. When the element 112 of FIG. 6*c* is used in array 100 of FIG. 6*a*, the lengths of the vertically polarized portions 118 are selected depending upon the location of the element in array 100, so as to reradiate a collimated beam of energy arriving from the direction of boresight axis 122 of array 100 to a first focal point 124 within the aperture of a vertically polarized feed horn illustrated as 126. Similarly, the horizontally polarized components 116 of re-reflector elements 112 of array 100 are dimensioned according to the location of the element on array 100, so as to re-reflect energy arriving from the direction of boresight axis 122 to a second focal point 128 within the aperture of horizontally polarized feed horn 130. Waveguide transmission lines 136 and 146 connect to feed horn 126 and 130, respectively, and are coupled by way of diplexers (not illustrated in FIG. 6*a*) to appropriate receivers (not illustrated in FIG. 6*a*).

Figure 6B:
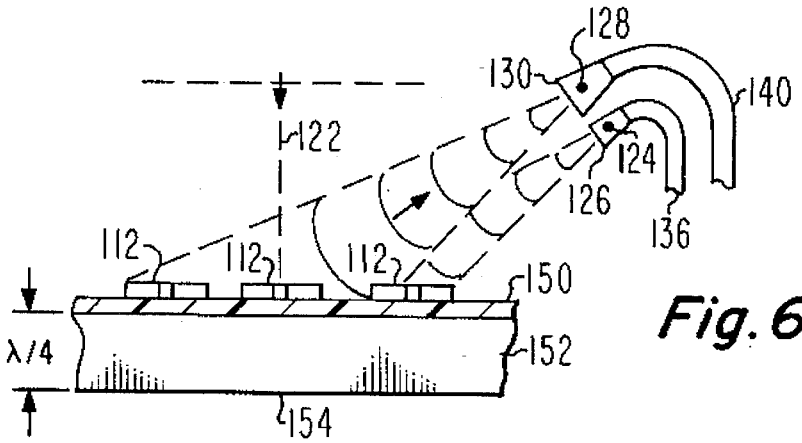
FIG. 6*b* is a side elevation thereof.
Figure 6C:
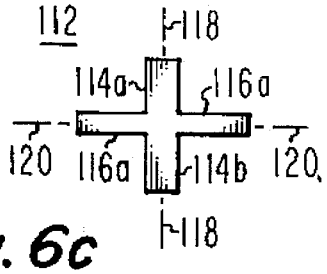
FIG. 6*c* is a plan view of a single reflectarray element of the arrangement of FIGS. 6*a* and 6*b;*

FIG. 6*b* is a side elevation view of the arrangement of FIG. 6*a*. Reradiating elements 112 are illustrated as printed elements formed on a dielectric substrate 150. As known, reradiating elements 112 reradiate energy toward both sides of dielectric substrate 150. The energy radiated in a direction opposite of the desired beam direction is not useful. In FIG. 6, substrate 150 is held in place by a support shell 152 made of electrically conductive material, in which a conductive bottom wall 154 is spaced one-quarter wavelength ($\lambda/4$) from the upper surface of dielectric substrate 150 on which reradiating elements 112 are held. As known, this tends to produce an effective open circuit at locations $\lambda/4$ from the conductive bottom surface 154, which tends to restrict the radiation to the desired direction.

Figure 7A:
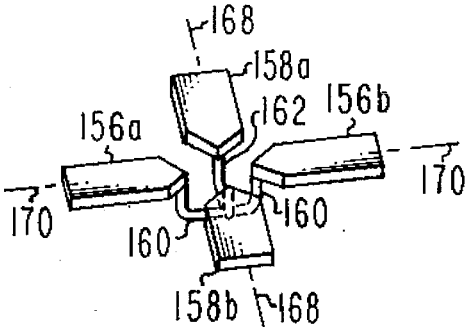
FIG. 7*a* is a simplified representation of another form of dual-polarized reflectarray antenna illustrating the use of phase shifting conductors.
Figure 7B:
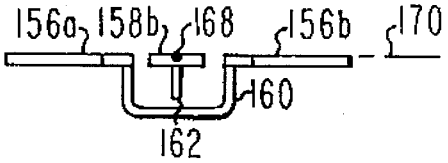
FIG. 7*b* is a side elevation view thereof.

FIG. 7*a* is a simplified perspective or isometric view of reradiating elements including additional non-radiating delay elements. In FIG. 7*a*, reradiating dipole-like elements 158*a* and 158*b* are elongated in the direction of an axis 168, and are tapered to points near the center of the structure, but do not touch. Electrical connection between the points of reradiating element portions 158*a* and 158*b* is provided by a wire illustrated as 162. A similar cross-polarized reradiated element includes tapered, non-touching portions 156*a* and 156*b*, elongated in the direction of an axis 170. The points of portions 156*a* and 156*b* are electrically interconnected by a conductor or wire 160. Interconnecting wires 160 and 162 are formed into a "U" shape, which extends below the plane of the dipole elements, and which is more visible in side elevation view of FIG. 7*b*. Such a structure may be considered to be the equivalent of a short-circuited two-wire transmission line, which provides almost lossless delay. Such an arrangement makes it easy to adjust phase shifts on an existing printed-circuit reradiating board.

Figure 8:
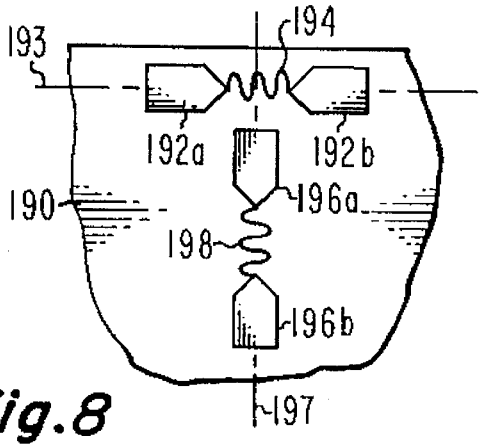
FIG. 8 illustrates an alternative layout of cross-polarized reflector elements which may be used in the arrangement of FIG. 6*a;*

FIG. 8 is a plan view of a portion of a substrate 190 similar to substrate 150 of FIG. 6*a* and 6*b*, but which supports independent radiators. In FIG. 8, a "horizontally" polarized reradiation element includes conductive portions 192*a* and 192*b*, interconnected by a thin meander line 194. A second reradiating element includes portions 196*a* and 196*b* elongated in the direction of an axis 198, which is orthogonal to axis 193. A meander line 198 interconnects conductive element 196*a* and 196*b*. As known, a meander line introduces delay in much the same fashion as conductors 160 and 162 of FIGS. 7*a* and 7*b*.

Figure 9:
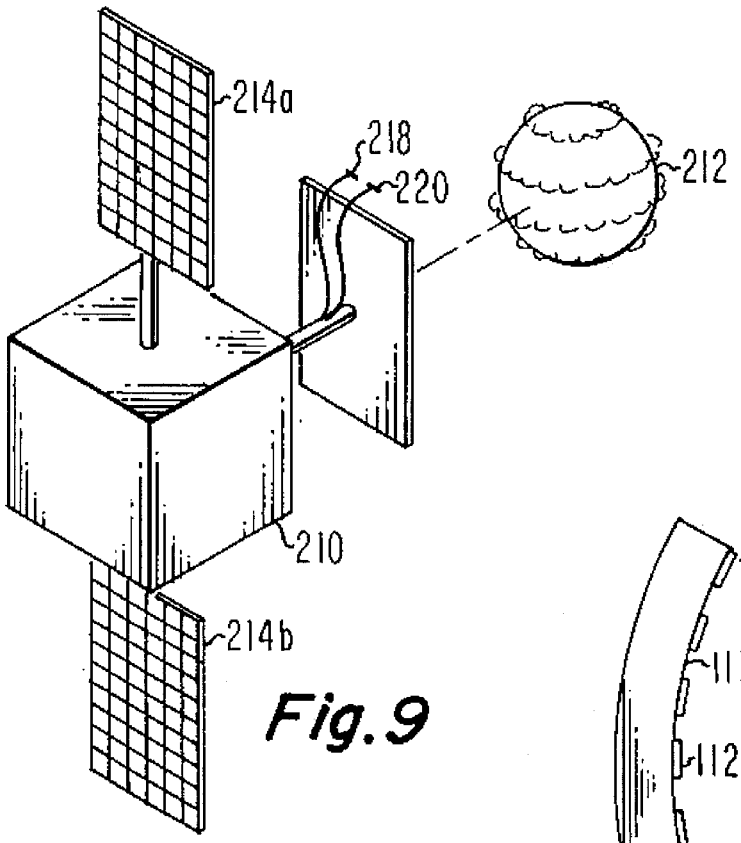
FIG. 9 represents a satellite including an antenna similar to that of FIG. 6*a*.

FIG. 9 illustrates a spacecraft including a body 210 orbiting a heavenly body 212. A pair of solar panels 214*a* and 214*b* provide electrical power to operate electrical portions of the satellite and its payload. The payload includes a communications system with a reflectarray antenna 216 in accordance with the invention, with a pair of feed antennas 218 and 220. Feed antennas 218 and 220 of reflectarray antenna 216 are connected by transmission lines to signal receivers or to signal sources, or both, in known manner, for providing communications between widely separated locations on the earth's surface.

In essence, array 110 of FIG. 6*a* includes two separate and independent reradiator arrays. Each array responds to one of two polarizations of an incident collimated beam, to focus the collimated beam at a focal point for this polarization, while the other polarization component of the incident beam is focused at a second focal point. In this fashion, a simple single-layer printed structure provides the same effect as a prior-art fore-and-aft orthogonal gridded parabolic reflector. This provides the potential for a lighter and simpler "parabolic" reflector for spacecraft use, which would allow loading more propellant for larger spacecraft life.

Figure 10A:
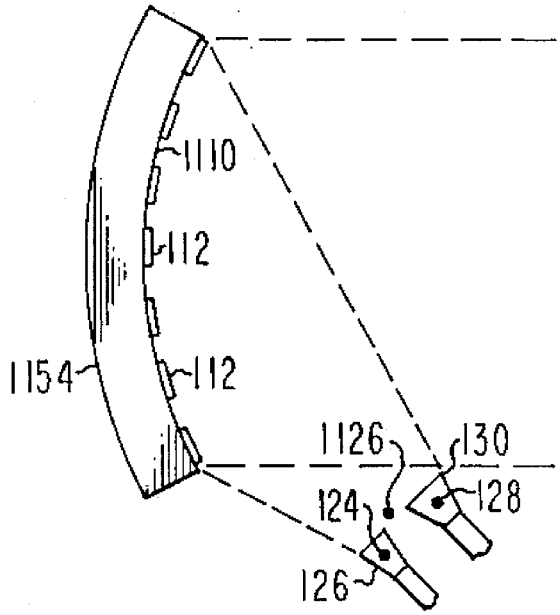
FIGS. 10*a* and 10*b* are simplified side sectional and perspective or isometric views, respectively, of a reflectarray antenna in accordance with the invention, in which the reradiating elements are on a nonplanar or parabolic surface.
Figure 10B:
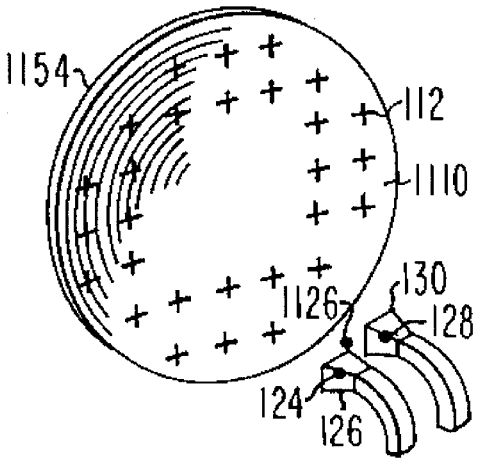

While each reradiator element can in principle add a phase shift of $\pm\pi$, additional phase shifts, if required to produce the desired beam shape, may require actual delays, corresponding to $N\pi$ phase increments, rather than simple phase shifts of up to $\pm\pi$. This may be accomplished, as illustrated in FIGS. 10*a* and 10*b*, by placing the reradiator elements, such as 112, on a dielectric substrate 1110 which is nonplanar. In FIGS. 10*a* and 10*b*, the substrate may assume a parabolic shape, with a single focus at a point, such as point 1126, between vertical and horizontal polarization focal point 126 and 128. With this arrangement, the phase shifts which are imparted to the reradiated signal are only required to shift the focal point from point 1126 to 126 (for vertical) or to 128 (for horizontal) polarization. As in the case of FIG. 6*b*, a conductive reflector 1154 backs the reradiator array, spaced therefrom by about $\lambda/4$ at the operating frequency.

Other embodiments of the invention will be apparent to those skilled in the art. In particular, the feed antenna for either or both polarizations of the reflectarray antenna may be a single horn, a plurality of horns, or may itself be an array of radiating elements. While the reradiators of the array of FIGS. 6*a* and 6*b* have been described as "printed", they may be fabricated as discrete units which are arrayed, assembled and supported in the absence of a substrate.

What is claimed is:

1. An antenna, comprising:

a first plurality of first reradiators of electromagnetic energy, each of said first reradiators including a straight electrical conductor elongated in the direction of an axis of elongation, and defining at least a lateral dimension in a direction transverse to said axis of elongation, the dimensions of each of said first reradiators being selected to provide a particular phase shift to reradiated energy at a predetermined frequency;

a second plurality, which may be equal to said first plurality, of second reradiators of electromagnetic energy, each of said second reradiators including a straight electrical conductor elongated in the direction of an axis of elongation, and defining at least a lateral dimension in a direction transverse to said axis of elongation, the dimensions of each of said second reradiators being selected to provide a particular phase shift to reradiated energy at said predetermined frequency;

arraying means, for arraying said first plurality of first reradiators in an array direction, on an array surface, to form a first array, with said axes of elongation of adjacent ones of said first reradiators substantially parallel to each other in order to reradiate a first linear polarization, the dimensions of each one of said first reradiators in said first array being selected, in dependence upon the location of said one of said first reradiators in said first array, so that said first array reradiates diverging energy received from a first focal point to produce a collimated beam of energy, and reradiates a received beam of collimated energy to produce a beam of energy converging toward said first focal point, and for arraying said second plurality of second reradiators in said array direction, on said array surface, to form a second array, with said axes of elongation of adjacent ones of said second reradiators substantially parallel to each other and substantially orthogonal to said axes of elongation of said first reradiators, the dimensions of each one of said second reradiators in said second array being selected, in dependence upon the location of said one of said second reradiators in said second array, so that said second array reradiates diverging energy received from a second focal point, different from said first focal point, to produce a collimated beam of energy, and reradiates a received beam of collimated energy to produce a beam of energy converging toward said second focal point;

first feed antenna means located at said first focal point for transducing signals of said first polarization; and second feed antenna means located at said second focal point for transducing signals of said second polarization.

2. An antenna according to claim 1, wherein said first and second feed antenna means comprise waveguide horns.

3. An antenna according to claim 1, wherein at least some of said first reradiators include a gap in the direction of said axis of elongation, and elongated conductive means bridging said gap, for introducing a phase shift.

4. An antenna according to claim 3, wherein said elongated conductive means bridging said gap is a meander line.

5. An antenna according to claim 3, wherein said elongated conductive means bridging said gap is a short-circuited transmission line.

6. An antenna according to claim 1, wherein at least some of said first and second reradiators are collocated.

7. An antenna according to claim 6, wherein each of said collocated first and second reradiators have the general appearance of a four-arm cross.

8. An antenna according to claim 7, wherein the arms of said four-arm cross are symmetrical.

9. An antenna according to claim 8, wherein said symmetrical arms are identical.

10. An antenna according to claim 1, wherein said array surface is planar.

11. An antenna according to claim 10, wherein said first array is a planar array.

12. An antenna according to claim 1, wherein said array surface is nonplanar.

13. An antenna according to claim 12 wherein said first array is a two-dimensional array fired to said nonplanar surface, whereby it becomes three-dimensional.

14. An antenna according to claim 13, wherein said second array is also a two-dimensional array fitted to said nonplanar surface.

15. An antenna according to claim 13, wherein said nonplanar surface is parabolic, with a focus near one of said first and second focal points.

16. An antenna according to claim 1 further comprising:

satellite mounting means;

a satellite body coupled to said mounting means;

at least one of signal generating means and signal receiving means coupled to said first and second feed antenna means; and at least one solar panel mounted on said body and coupled to said one of said generating and receiving means for energization thereof.

17. An antenna, comprising:

a first plurality of first reradiators of electromagnetic energy, each of said first reradiators being sensitive to a first polarization, the dimensions of each of said first reradiators being selected to provide a particular phase shift to reradiated energy of said first polarization at a predetermined frequency;

a second plurality, which may be equal to said first plurality, of second reradiators of electromagnetic energy, each of said second reradiators being sensitive to a second polarization orthogonal to said first polarization, the dimensions of each of said second reradiators being selected to provide a particular phase shift to reradiated energy of said second polarization at said predetermined frequency;

arraying means, for arraying said first plurality of first reradiators in an array direction, on an array surface, to form a first array, with said first reradiators oriented to respond to said first polarization, the dimensions of each one of said first reradiators in said first array being selected, in dependence upon the location of said one of said first reradiators in said first array, so that said first array reradiates diverging energy received from a first focal point to produce a collimated beam of energy, and reradiates a received beam of collimated energy to produce a beam of energy converging toward said first focal point, and for arraying said second plurality of second reradiators in said array direction, on said array surface, to form a second array, with said second reradiators oriented to respond to said second polarization, the dimensions of each one of said second reradiators in said second array being selected, in dependence upon the location of said one of said second reradiators in said second array, so that said second array reradiates diverging energy received from a second focal point, different from said first focal point, to produce a collimated beam of energy, and reradiates a received beam of collimated energy to produce a bum of energy converging toward said second focal point;

first feed antenna means located at said first focal point for transducing signals of said first polarization; and second feed antenna means located at said second focal point for transducing signals of said second polarization.

18. An antenna according to claim 17, wherein at least some of said first and second reradiators are collocated.

19. An antenna according to claim 17, wherein said array surface is planar.

20. An antenna according to claim 17, wherein said array surface is nonplanar.

* * * * *